United States Patent [19]

McKinnon et al.

[11] Patent Number: 5,052,574

[45] Date of Patent: Oct. 1, 1991

[54] TAMPER-PROOF AND TAMPER-EVIDENT CONTAINER CLOSURE SYSTEM

[75] Inventors: Lee McKinnon, Aurora; Imre J. Buza, South Euclid; Terry L. Hartman, Solon; Arthur H. Blackburn, Aurora, all of Ohio

[73] Assignee: Cardinal Packaging Inc., Streetsboro, Ohio

[21] Appl. No.: 480,772

[22] Filed: Feb. 16, 1990

[51] Int. Cl.[5] ..... B65D 17/40

[52] U.S. Cl. ..... 220/276; 220/270; 215/254

[58] Field of Search ..... 220/270, 276, 306; 215/254

[56] References Cited

U.S. PATENT DOCUMENTS

| | | | |
|---|---|---|---|
| 3,858,748 | 1/1975 | Marco | 220/276 |
| 4,024,976 | 5/1977 | Acton | 220/276 X |
| 4,111,329 | 9/1978 | Lampman | 220/306 X |
| 4,190,175 | 2/1980 | Allen | 220/270 |
| 4,385,711 | 5/1983 | Bowen | 220/306 X |
| 4,711,364 | 12/1987 | Letica | 220/276 |
| 4,759,465 | 7/1988 | Landis | 220/276 |

*Primary Examiner*—Stephen Marcus
*Assistant Examiner*—Nova Stucker
*Attorney, Agent, or Firm*—Fay, Sharpe, Beall, Fagan, Minnich & McKee

[57] ABSTRACT

A tamper-proof and tamper-evident closure system is for use with a plastic container body and lid of the type wherein the container body has an opening defined by a continuous side wall and the lid has a depending skirt terminating at a lower edge, with the skirt overlapping the side wall adjacent the opening when the lid covers the opening. The closure system comprises a shield flange projecting outwardly from the side wall of the container body imemdiately adjacent the lower edge of the lid when the lid covers the opening of the container body and a tamper-evidencing band frangibly connected to the shield flange along a separation path spaced from the side wall of the container body. The shield flange bars access to a substantial portion of the lower edge and includes a cut-out section providing access to a minor portion of the lower edge of the lid to permit removal of the lid from the container body. The tamper-evidencing band sufficiently surrounds the lower edge of the lid when the lid covers the opening of the container body to make removal of the lid difficult without separating a portion of the tamper-evidencing band from the shield flange. Preferably, the tamper-evidencing band includes a blocking lug substantially covering the cut-out section of the shield flange when the tamper-evidencing band is connected to the shield flange. The blocking lug blocks access to the lower edge of the lid through the cut-out section until the tamper-evidencing band is separated from the shield flange adjacent the cut-out section. The container, shield flange, and the tamper-evidencing band preferably are molded in unison.

8 Claims, 2 Drawing Sheets

FIG. 1
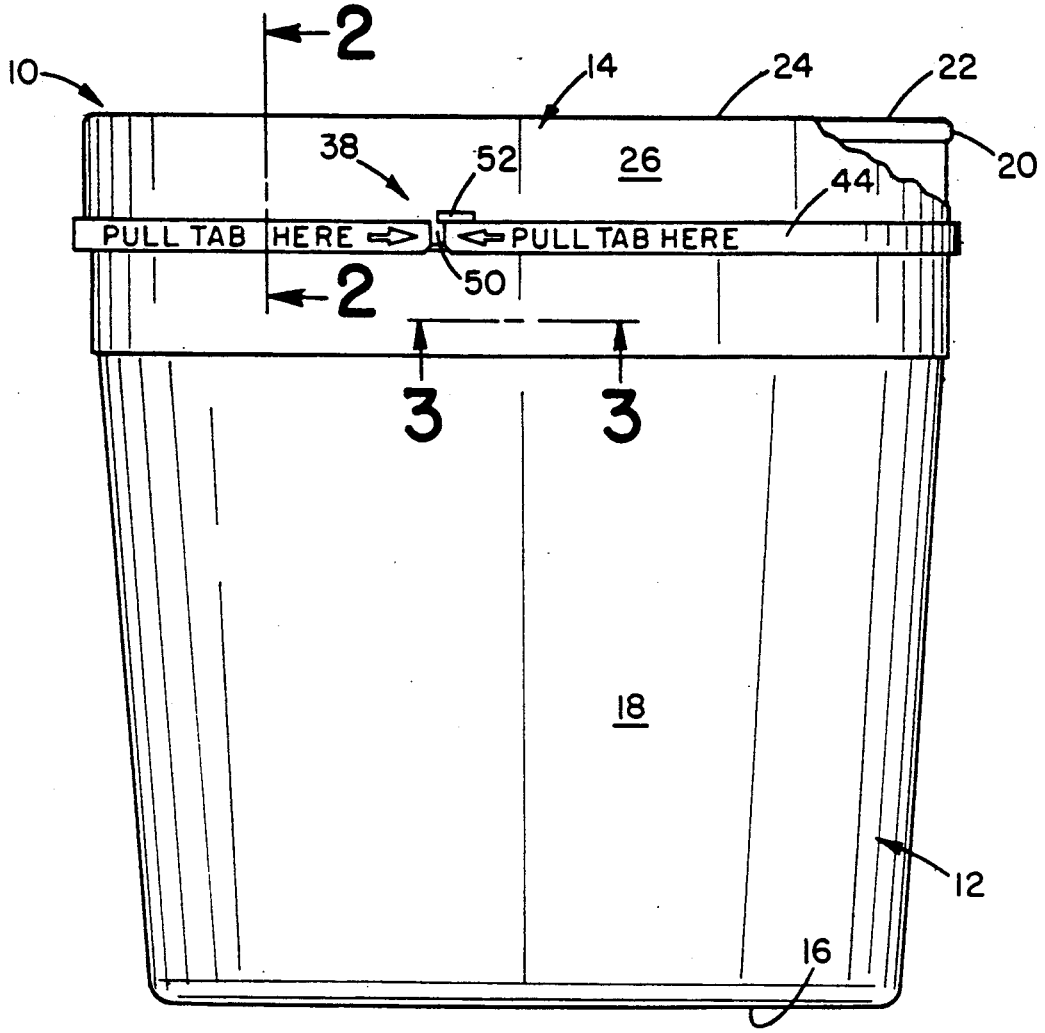
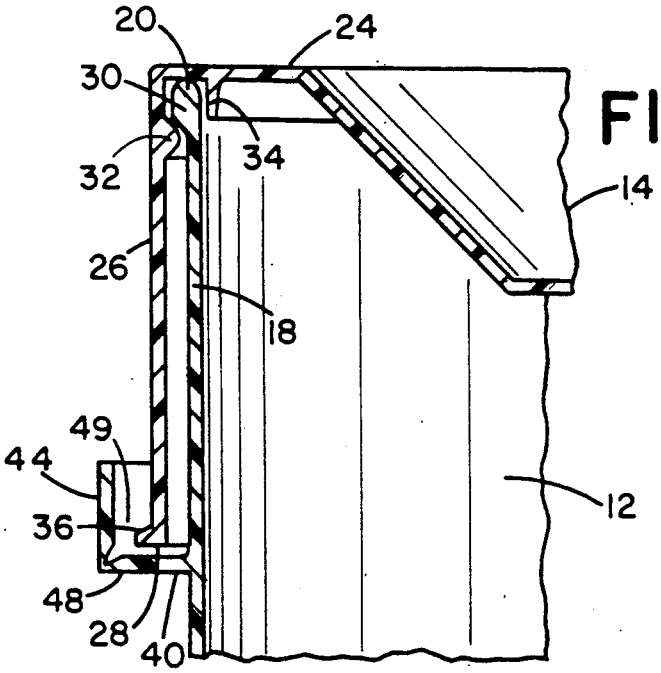
FIG. 2
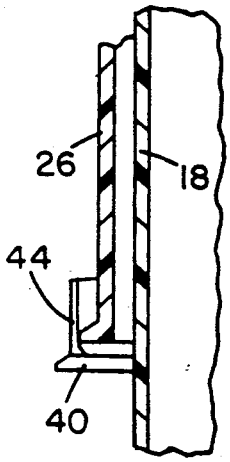
FIG. 5

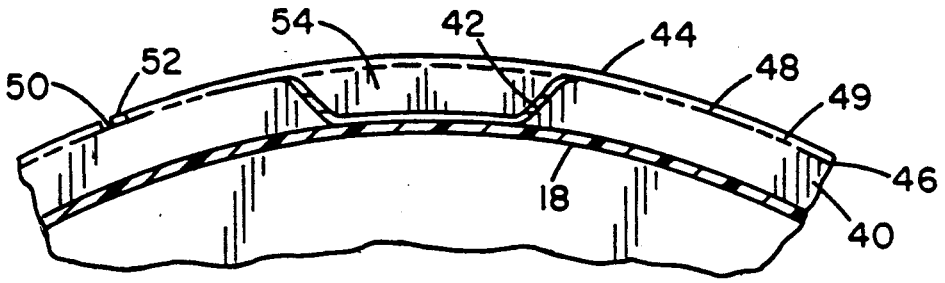
FIG. 3
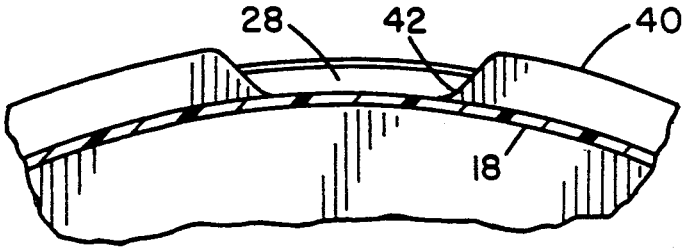
FIG. 6
FIG. 4
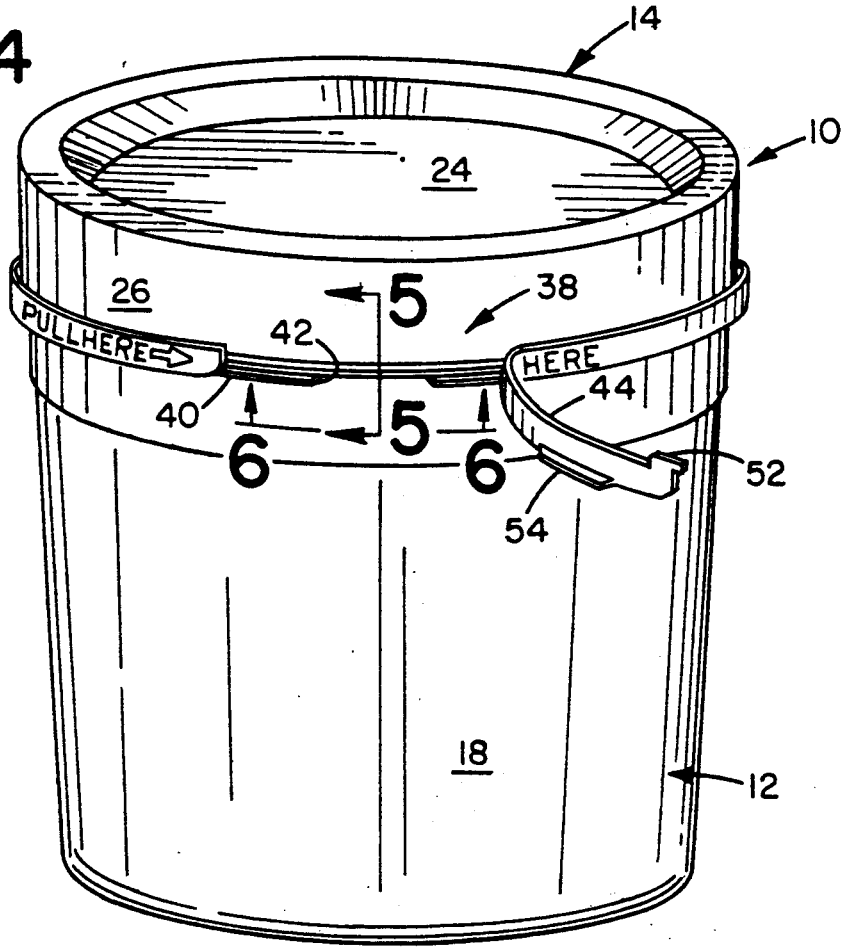

TAMPER-PROOF AND TAMPER-EVIDENT CONTAINER CLOSURE SYSTEM

BACKGROUND OF THE INVENTION

The present invention relates to plastic containers. In particular, the present invention relates to a plastic container having a tamper-proof and/or tamper-evident closure mechanism that protects against unauthorized opening of the container.

As incidents of product tampering have increased in recent years, the marketplace has demanded that food and pharmaceutical containers contain features that both inhibit unauthorized opening of the containers and provide clear evidence of tampering when unauthorized opening takes place. The problem of providing an effective closure system is particularly acute with wide-mouth plastic containers, for which it is desirable to provide ease of repeated opening and closing by the purchaser after the product is bought. Although a tamper-proof and tamperevident closure system will interfere to degree with the initial opening, it should not substantially impede subsequent openings.

One proposal for a tamper-proof closure system, based on U.S. Pat. No. 4,027,775, provides a container body with an outwardly extending flange disposed immediately beneath the lower edge of the container lid. The flange includes a removable section frangibly connected to the container body. The flange inhibits access of the human finger to the lower edge and thus makes opening the container difficult until the removable section is detached and a portion of the lid's lower edge is exposed. Unfortunately, this configuration does not significantly deter unauthorized opening of the container by prying between the flange and lower lid edge with, for example, a knife blade. In addition, it does not provide readily apparent visual evidence of unauthorized opening.

Another proposed system, disclosed in U.S. Pat. Nos. 4,024,976 and 4,190,175, provides an L-shaped tear strip frangibly attached to the container body side wall to cover the lower edge of the lid. Access of one's finger to the lower lid edge is barred until the tear strip is removed. Although this system provides visual evidence that the container has been opened in the conventional manner, it will neither prevent nor render visually evident tampering by someone who inserts a knife blade or similar tool through the weakened section between the strip and container body side wall to push off the lid.

The present invention is intended to provide a lo container closure system that both inhibits unauthorized opening to the container and leaves visual evidence when an attempt is made to open the container.

The present invention also is intended to provide a tamper-proof and tamper-evident container closure system that guards against unauthorized opening by use of a knife blade or similar tool.

Additional advantages of the present invention will be set forth in part in the description that follows, and in part will be obvious from that description or can be learned by practice of the invention. The advantages of the invention can be realized and obtained by the apparatus particularly pointed out in the appended claims.

SUMMARY OF THE INVENTION

The present invention overcomes the problems of prior art container closure systems by providing a shield flange projecting outwardly from the side wall of the container body and a tamper-evidencing band frangibly connected to the shield flange along a path spaced from the container body side wall. Both the shield flange and frangible band bar access to the lower edge of the lid to prevent opening of the lid with one's finger without first separating the band from the shield flange. The shield flange also inhibits unauthorized opening of the container by use of a knife blade or similar tool.

To overcome the problems of the prior art container closure systems, and in accordance with the purpose of the invention, as embodied and broadly described herein, the tamper-proof and tamper-evident closure system of this invention is for use with a plastic container body and lid of the type wherein the container body has an opening defined by a continuous side wall and the lid has a depending skirt terminating at a lower edge, the skirt overlapping the side wall adjacent the opening when the lid covers the opening. The closure system comprises means for shielding the lower edge of the skirt to inhibit removal of the lid from the container body. The shielding means includes a shield flange projecting outwardly from the side wall of the container body immediately adjacent the lower edge of the lid when the lid covers the opening of the container body. The closure system also comprises a tamper-evidencing band frangibly connected to the shield flange along a separation path spaced from the side wall of the container body. The shield flange bars access to a substantial portion of the lower edge and includes a cutout section providing access to a minor portion of the lower edge of the lid to permit removal of the lid from the container body. The tamper-evidencing band sufficiently surrounds the lower edge of the lid when the lid covers the opening of the container body to make removal of the lid difficult without separating a portion of the tamperevidencing band from the shield flange.

In the preferred embodiment of the invention, the tamper-evidencing band includes a blocking lug substantially covering the cut-out section of the shield flange when the tamper-evidencing band is connected to the shield flange. The blocking lug blocks access to the lower edge of the lid through the cut-out section until the tamper-evidencing band is separated from the shield flange adjacent the cut-out section. The container, shield flange, and the tamper-evidencing band preferably are molded in unison.

The accompanying drawings, which are incorporated in and which constitute a part of this specification, illustrate at least one embodiment of the invention and, together with the description, explain the principles of the invention.

BRIEF DESCRIPTION OF THE DRAWINGS

FIG. 1 is a partially cut-away, elevational view of a container system having the closure system of the present invention;

FIG. 2 is cross-sectional view, taken along line 2—2 of FIG. 1, of a portion of the container closure system of the present invention;

FIG. 3 is a view, taken along line 3—3 of FIG. 1, of the cut-out section of the shield flange of the present invention;

FIG. 4 is a perspective view of the container system of FIG. 1 with the tamper-evidencing band removed in the vicinity of the cut-out section of the shield flange;

FIG. 5 is cross-sectional view, taken along line 5—5 of FIG. 4, of a portion of the container closure system of the present invention; and FIG. 6 is a view, taken along line 6—6 of FIG. 4, of the cut-out section of the shield flange of the present invention.

DESCRIPTION OF THE PREFERRED EMBODIMENT

Reference now will be made in detail to the presently preferred embodiment of the invention, an example of which is illustrated in the accompanying drawings.

FIG. 1 shows a container system, designated generally by reference numeral 10, that includes the tamper-proof and tamper-evident closure system of the present invention. Container system 10 includes a container body, generally designated by reference numeral 12, and a lid, generally designated by reference numeral 14. The container body and lid shown in the drawings are particularly suitable for containing ice cream or similar products. Container body 12 and lid 14 preferably are comprised of a molded thermoplastic material.

In the embodiment shown in the drawings, container body 12 is generally tub-shaped, having a generally circular bottom wall 16 and a continuous side wall 18 joined to bottom wall 16. At its upper end, side wall 18 terminates in an annular rim 20 spaced from bottom wall 16. Rim 20 defines a circular opening 22.

Lid 14 includes a top wall member 24 having a circular configuration to cover opening 22. As shown in FIGS. 2 and 4, top wall member 24 of the presently preferred embodiment of lid 14 includes a depressed center section. Lid 14 further includes a skirt 26 depending from top wall member 24. As shown in FIG. 2, skirt 26 terminates at lower edge 28 and overlaps side wall 18 of container body 12 adjacent rim 20 when lid 14 covers opening 22.

As will be apparent to those of ordinary skill in the art, container body 12 and lid 14 can have a variety of shapes and configurations other than as shown in the present drawings. For example, container body 12 and lid 14 can be rectangular in cross section instead of circular.

As shown in FIG. 2, container body 12 preferably is provided with a substantially continuous bead 30 of enlarged cross-section at rim 20. In order to provide a secure closure of container system 10, lid 14 includes projection 32 extending laterally inward from the inside surface of skirt 26 and projection 34 extending vertically downward from the underside of top wall member 24. Lateral projection 32 and vertical projection 34 provide a snap fit around bead 30 to secure lid 14 firmly in place over opening 22 of container body 12. Preferably, lid 14 also includes an outwardly extending continuous lip 36 along lower edge 28 to facilitate removal of lid 14 from container body 12.

In accordance with the invention, container system 10 includes a tamper-proof and tamper-evident closure system, designated generally by reference numeral 38. Closure system 38 includes means for shielding lower edge 28 of skirt 26 to inhibit removal of lid 14 from opening 22 of container body 12. As embodied herein, the shielding means of this invention includes shield flange 40 projecting outwardly from side wall 18 of container body 12 immediately adjacent lower edge 28 of skirt 26 when lid 14 covers opening 22.

Shield flange 40 bars access by the human finger to a substantial portion of lower edge 28 to inhibit removal of lid 14. Shield flange 40 includes a cut-out section 42 that provides access to a minor portion of lower edge 28 to permit removal of lid 14 from container body 12 under restricted conditions to be discussed below.

In accordance with the invention, container closure system 38 also includes a tamper-evidencing band 44 frangibly connected to shield flange 40 along a separation path 46 spaced from side wall 18. Tamper-evidencing band 44 sufficiently surrounds lower edge 28 of skirt 26 when lid 14 covers opening 22 to make removal of lid 14 difficult without separating a portion of band 44 from shield flange 40.

Shield flange 40 and tamper-evidencing band 44 preferably are molded in unison with container body 12. The frangible connection between tamper-evidencing band 44 and shield flange 40 preferably is provided by regions of weakness 48 and bridge connections 49, which alternate with each other along the circumference of container body 12. Regions 48 can be either molded in during the fabrication of container body 12 or machined in subsequently.

Tamper-evidencing band 44 preferably is discontinuous, having two ends separated by a gap 50 adjacent cut-out section 42. Alternatively, band 44 can be continuous, with its ends connected by a frangible member bridging gap 50. Tab 52 preferably is provided on one end of band 44 adjacent gap 50 to facilitate removal of band 44. Band 44 can be provided with molded-in written instructions such as the "PULL TAB HERE" notation shown in FIG. 1.

As shown in FIG. 3, tamper-evidencing band 44 preferably includes blocking plug 54, which has a shape complementary to and fits into cut-out section 42. Blocking plug 54 blocks access to lower edge 28 of lid 14 through cut-out section 42 until band 44 is separated from the shield flange 40.

In FIGS. 1-3, container system 10 is shown in its closed configuration, as it would appear, for example, upon leaving the packing or processing plant for transit to a retail store. Operation of the closure system of the present invention now will be described with reference to FIGS. 4-6.

In order to remove lid 14 from container body 12, one preferably grips tab 52 at one end of tamper-evidencing band 44 and strips band 44 off shield flange 40 and away from container body 12, as shown in FIG. 4. If desired, band 44 can be removed entirely from shield flange 40 and discarded. Removing band 44 from shield flange 40 in the vicinity of cut-out section 42 exposes a portion of lower edge 28 of skirt 26, as shown in FIGS. 5 and 6, which then permits lid 14 to be removed by exerting an upward force with one's finger on lower edge 28 at cut-out section 42. If an attempt is made to open container system !0 before it is sold, the tampering will be readily apparent to visual inspection because tampering-evidencing band 44 will be detached from shield flange 40.

Shield flange 40 and tamper-evidencing band 44 not only guard against a potential tamperer removing lid 14 with his or her finger, but they also inhibit prying open lid 14 with a knife or similar tool. If a tamperer attempts to insert a knife blade upwardly through the gap between blocking lug 54 and cut-out section 42, or tries to pry open lid 14 by inserting a knife between skirt 26 and band 44, the attempt will likely cause a permanent separation of band 44 from shield flange 40, which will leave visual evidence of the tampering.

Furthermore, by providing a permanent connection of shield flange 40 to side wall 18, container system 10 not only guards against tampering but diminishes the likelihood that the container will be accidentally opened by a person carelessly gripping the container by its lid. Access to lower edge 28 is provided only at cut-out section 42.

It will be apparent to those skilled in the art that other modifications and variations can be made in the apparatus of the invention without departing from the scope of the invention. For example, a plurality of cut-out sections can be provided in shield flange 40, spaced along the circumference of the container body. Each cut-out section preferably would be covered by a locking lug. The invention in its broader aspects is, therefore, not limited to the specific details and illustrated examples shown and described. Accordingly, it is intended that the present invention cover such modifications and variations provided that they fall within the scope of the appended claims and their equivalents.

What is claimed is:

1. A tamper-proof and tamper-evident closure system for use with a plastic container body and lid of the type wherein the container body has an opening defined by a continuous side wall and the lid has a depending skirt terminating at a lower edge, the skirt overlapping the side wall adjacent the opening when the lid covers the opening, the closure system comprising:

a. means for shielding the lower edge of the skirt to inhibit removal of the lid from the container body, said shielding means including a shield flange projecting outwardly from the side wall of the container body immediately adjacent the lower edge of the lid when the lid covers the opening of the container body, said shield flange barring access to a substantial portion of the lower edge, said shield flange including a cut-out section providing access to a minor portion of the lower edge of the lid to permit removal of the lid from the container body; and b. a tamper-evidencing band frangibly connected to said shield flange along a separation path spaced from the side wall of the container body, said tamper-evidencing band sufficiently surrounding the lower edge of the lid when the lid covers the opening of the container body to make removal of the lid difficult without separating a portion of said tamper-evidencing band from said shield flange.

2. The system of claim 1, wherein said tamper-evidencing band includes a blocking lug substantially covering said cut-out section of said shield flange when said tamper-evidencing band is connected to said shield flange, said blocking lug blocking access to the lower edge of the lid through said cut-out section until said tamper-evidencing band is separated from said shield flange adjacent said cut-out section.

3. The system of claim 1, wherein the container body, said shield flange, and said tamper-evidencing band are molded in unison.

4. A tamper-proof and tamper-evident closure system for use with a plastic container body and lid of the type wherein the container body has an opening defined by a continuous side wall and the lid has a depending skirt terminating at a lower edge, the skirt overlapping the side wall adjacent the opening when the lid covers the opening, the closure system comprising:

a. means for shielding the lower edge of the skirt to inhibit removal of the lid from the container body, said shielding means including a shield flange projecting outwardly from the side wall of the container body immediately adjacent the lower edge of the, lid when the lid covers the opening of the container body, said shield flange barring access to a substantial portion of the lower edge, said shield flange including a cut-out section providing access to a minor portion of the lower edge of the lid to permit removal of the lid from the container body; and b. a tamper-evidencing band frangibly connected to said shield flange along a separation path spaced from the side wall of the container body, said tamper-evidencing band sufficiently surrounding the lower edge of the lid when the lid covers the opening of the container body to make removal of the lid difficult without separating a portion of said tamper-evidencing band from said shield flange, said tamper-evidencing band including a blocking lug substantially covering said cut-out section of said shield flange when said tamper-evidencing band is connected to said shield flange to block access to the lower edge of the lid through said cut-out section until said tamper-evidencing band is separated from said shield flange, said tamper-evidencing band further including an enlarged tab adjacent said blocking lug so that removal of the portion of said tamper-evidencing band adjacent said tab removes said blocking lug from said cut-out section of said shield flange.

5. A tamper-proof and tamper-evident container system, comprising:

a. a container body including a bottom wall and a continuous side wall joined to said bottom wall, said side wall terminating in an annular rim spaced from said bottom wall, said rim defining an opening;

b. a lid including a top wall member configured to cover said opening of said container body and a skirt depending from said top wall member, said skirt terminating at a lower edge and overlapping said side wall of said container body adjacent said rim when said lid covers said opening;

c. means for shielding said lower edge of said skirt to inhibit removal of said lid from said opening of said container body, said shielding means including a shield flange projecting outwardly from said side wall of said container body immediately adjacent said lower edge of said lid when said lid covers said opening of said container body, said shield flange barring access to a substantial portion of said lower edge, said shield flange including a cut-out section providing access to a minor portion of said lower edge of said lid to permit removal of said lid from said container body; and d. a tamper-evidencing band frangibly connected to said shield flange along a separation path spaced from said side wall of said container body, said tamper-evidencing band sufficiently surrounding said lower edge of said lid when said lid covers said opening of said container body to make removal of said lid difficult without separating a portion of said tamper-evidencing band from said shield flange.

6. The system of claim 5, wherein said tamper-evidencing band includes a blocking lug substantially covering said cut-out section of said shield flange when said tamper-evidencing band is connected to said shield flange, said blocking lug blocking access to said lower edge of said lid through said cut-out section until said tamper-evidencing band is separated from said shield flange.

7. The system of claim 5, wherein said container body, said shield flange, and said tamper-evidencing band are molded in unison.

8. A tamper-proof and tamper-evident container system, comprising:

a. a container body including a bottom wall and a continuous side wall joined to said bottom wall, said side wall terminating in an annular rim spaced from said bottom wall, said rim defining an opening;

b. a lid including a top wall member configured to cover said opening of said container body and a skirt depending from said top wall member, said skirt terminating at a lower edge and overlapping said side wall of said container body adjacent said rim when said lid covers said opening;

c. means for shielding said lower edge of said skirt to inhibit removal of said lid from said container body, said shielding means including a shield flange projecting outwardly from said side wall of said container body immediately adjacent said lower edge of said lid when said lid covers said opening of said container body, said shield flange barring access to a substantial portion of said lower edge, said shield flange including a cut-out section providing access to a minor portion of said lower edge of said lid to permit removal of said lid from said container body; and d. a tamper-evidencing band frangibly connected to said shield flange along a separation path spaced from said side wall of said container body, said tamper-evidencing band sufficiently surrounding said lower edge of said lid when said lid covers said opening of said container body to make removal of said lid difficult without separating a portion of said tamper-evidencing band from said shield flange, said tamper-evidencing band including a blocking lug substantially covering said cut-out section of said shield flange when said tamper-evidencing band is connected to said shield flange to block access to said lower edge of said lid through said cut-out section until said tamper-evidencing band is separated from said shield flange, said tamper-evidencing band further including an enlarged tab adjacent said blocking lug so that removal of said portion of said tamper-evidencing band adjacent said tab removes said blocking lug from said cut-out section of said shield flange.

* * * * *